United States Patent [19]

Mueller

[11] Patent Number: 4,812,122

[45] Date of Patent: Mar. 14, 1989

[54] ARTILLERY TRAINING APPARATUS WITH RECOIL/COUNTERRECOIL SIMULATION

[75] Inventor: Helmar A. Mueller, York, Pa.

[73] Assignee: Harsco Corporation, Wormleysburg, Pa.

[21] Appl. No.: 865,802

[22] Filed: May 22, 1986

[51] Int. Cl.[4] ..... F41F 27/00

[52] U.S. Cl. ..... 434/18; 434/24

[58] Field of Search ..... 434/18, 24

[56] References Cited

U.S. PATENT DOCUMENTS 4,194,304 3/1980 Wolcott ..... 434/18

4,591,342 5/1986 Lipp ..... 434/18

*Primary Examiner*—Maryann Lastova

*Attorney, Agent, or Firm*—Kerkam, Stowell, Kondracki & Clarke

[57] ABSTRACT

Cannon system training apparatus employs a double acting hydraulic cylinder controlled by an electrically operated directional control valve which controls the supply of hydraulic fluid to the double acting hydraulic cylinder in such a manner as to cause the gun tube to execute a recoil/counterrecoil cycle similar to that which would occur during an actual firing of the cannon system. A counterrecoil accumulator stores energy in the form of pressurized hydraulic fluid expelled from the hydraulic cylinder during recoil for counterrecoiling the gun tube. The gun tube is formed to enable dummy projectiles and simulated propellant charges to pass easily through the gun tube and to be ejected from the muzzle end by the ramming system employed.

9 Claims, 2 Drawing Sheets

ARTILLERY TRAINING APPARATUS WITH RECOIL/COUNTERRECOIL SIMULATION

BACKGROUND OF THE INVENTION

This invention relates to apparatus for realistically training artillery crews in the activities associated with the loading and firing of an artillery piece or other cannon system.

In the past, providing realistic training to crews on cannon systems has often necessitated conducting training firings of the cannon system using live ammunition. This is not only expensive and is necessarily restricted to approved and often remote areas, it is also hazardous to an inexperienced crew. To reduce such problems, cannon firing trainers have been developed which use dummy ammunition and reduced propellant charges. Although this reduces the costs and some of the problems associated with conducting training firings using live ammunition, known firing trainers are not entirely satisfactory. The reduced propellant charges employed must be sufficient to ensure that the dummy projectiles are expelled from the gun tube. However, the force produced by such reduced propellant charges is insufficient to recoil the cannon realistically. Accordingly, some known trainers have employed sensors for detecting the passage of the dummy projectile through the gun muzzle and rather complicated systems for moving the gun barrel through a recoil-counterrecoil cycle each time a round is fired. Since rounds are actually fired, such trainers must still be used in restricted areas and still pose some hazards to personnel. Moreover, local ordinances aimed at reducing noise levels may pose restrictions on training operations which involve actual firing of the cannon system.

It is desirable to provide cannon system training apparatus which enables realistic training of personnel on all of the loading and firing activities associated with operating a cannon system, while avoiding the disadvantages of known training apparatus, and it is to this end that the present invention is directed.

SUMMARY OF THE INVENTION

The invention affords cannon system training apparatus which enables realistic training of personnel on all cannon system operations and firing activities without using live explosives or even reduced propellant charges, thereby enabling the apparatus to be employed for training even at the battery level. Apparatus in accordance with the invention has a rather simplified structure, and may be implemented either as a stand alone system, or as a rather simple adaptation of an existing cannon system. The invention may temporarily replace the actual cannon system on a vehicle, such as a tank or self-propelled howitzer or any other weapon mounted equipment, as well as replace existing training devices. It permits a crew to perfect their live-fire crew drill while experiencing the feeling of firing in a vehicle with or around the cannon system without actually firing rounds down range. The apparatus may employ projectiles which are simulated in weight and size to actual combat rounds, and may employ exact duplicates of propellants, primers, and other parts of the ammunition train of a real device.

Broadly stated, in one aspect the invention affords cannon system training apparatus which includes a gun tube supported by mounting means for reciprocal movement between an in-battery position and a recoiled position. Hydraulic cylinder means is connected to the gun tube and to the mounting means for moving the gun tube between the in-battery and recoiled positions. The hydraulic cylinder means is responsive to hydraulic fluid supplied to a first inlet of the hydraulic cylinder means for moving the gun tube in a first direction to the in-battery position, and is responsive to hydraulic fluid supplied to a second inlet of the hydraulic cylinder means for moving the gun tube in a second position to the recoiled position. A first source of pressurized hydraulic fluid is connected to the first inlet. To effect recoil, hydraulic control means connects a second source of pressurized hydraulic fluid to the second inlet of the hydraulic cylinder means to cause the gun tube to move from the in-battery position to the recoiled position. Upon the gun tube reaching the recoiled position, the hydraulic control means is switched to disconnect the second inlet from the second source, and the pressurized hydraulic fluid from the first source causes the gun tube to move back to the in-battery position, thereby causing the gun tube to execute recoil and counterrecoil motions.

More specifically, the invention employs a double acting hydraulic cylinder for controlling movement of the gun tube between the in-battery and recoiled positions, and an electrically operated directional control valve for controlling the supply of pressurized hydraulic fluid to the double acting cylinder. In one position of the directional control valve, pressurized hydraulic fluid stored in a countercoil accumulator is applied to the double acting cylinder in such a manner as to urge the gun tube to the in-battery position, which insures that the gun tube is held positively in the in-battery position. In response to a firing signal, the directional control valve switches to a second position in which it supplies hydraulic fluid at a greater pressure from another source to the double acting cylinder in such a manner as to drive the gun tube toward a recoiled position. During this movement, the hydraulic fluid discharged from the hydraulic cylinder is supplied to the counterrecoil accumulator. Upon the gun tube reaching the recoiled position, the directional control valve is switched back to the first position, disconnecting the source of greater pressure, and the energy stored in the counterrecoil accumulator in the form of pressurized hydraulic fluid is supplied to the hydraulic cylinder so as to move the gun tube back to the in-battery position. Variable flow control valves in the lines connected to the inlets of the hydraulic cylinder enable the flow rates to be controlled so as to control the recoil and counterrecoil speeds, and may be adjusted such that the recoil and the counterrecoil motions of the gun tube closely simulate those which would occur during an actual firing of the cannon system.

DESCRIPTION OF A PREFERRED EMBODIMENT

The invention is particularly well adapted for use with artillery pieces and other similar cannon systems and will be described in that context. However, as will be appreciated, this is illustrative of only one utility of the invention.

In order to afford realistic training, it is necessary that a cannon system firing trainer simulate closely the operations of an actual cannon system so that the crew can perform all of the loading and firing activities and experience the feeling of firing an actual system. The invention affords a trainer which accomplishes these objectives without actually firing rounds down range. The trainer may be implemented either as a device constructed especially for training purposes, or by adaptation of an existing cannon system, the latter approach being preferable since it enables an actual system to be employed for training. When adapting an actual system, the existing gun barrel is replaced with a simulated gun tube, or, alternatively, an old gun barrel which has exceeded its useful tube life may be modified, to enable projectiles and propellant charges to pass freely through the tube barrel during a loading/ramming cycle. The invention contemplates the use of dummy projectiles, simulated propellant charges, and simulated primers, all having the same size, shape and weight of actual devices. The dummy projectiles and simulated propellant charges are loaded and rammed either manually or automatically, in accordance with the method used on the actual cannon system. The energy imparted to the projectile and propellant charge by the ramming system pushes the projectile and propellant charge through the tube during the loading cycle, so that they are expelled from the tube and may be caught for reuse. After loading and firing preparations have been completed, a simulated firing is performed by pulling a lanyard or operating a switch, depending upon the method employed on the particular cannon system. This provides an electrical signal to a hydraulic/electric system, to be described more fully shortly, which causes the cannon system to execute a recoil/counterrecoil cycle similar to that which would occur during an actual firing. During this cycle, the primer is expelled in the same manner as it would be during an actual firing. The trainer may then be reloaded and fired again. Since the trainer reacts in the same manner as an actual cannon system, it enables a crew to experience under realistic conditions the actual motions and reactions of the cannon system without actually firing rounds down range.

Figure 1:
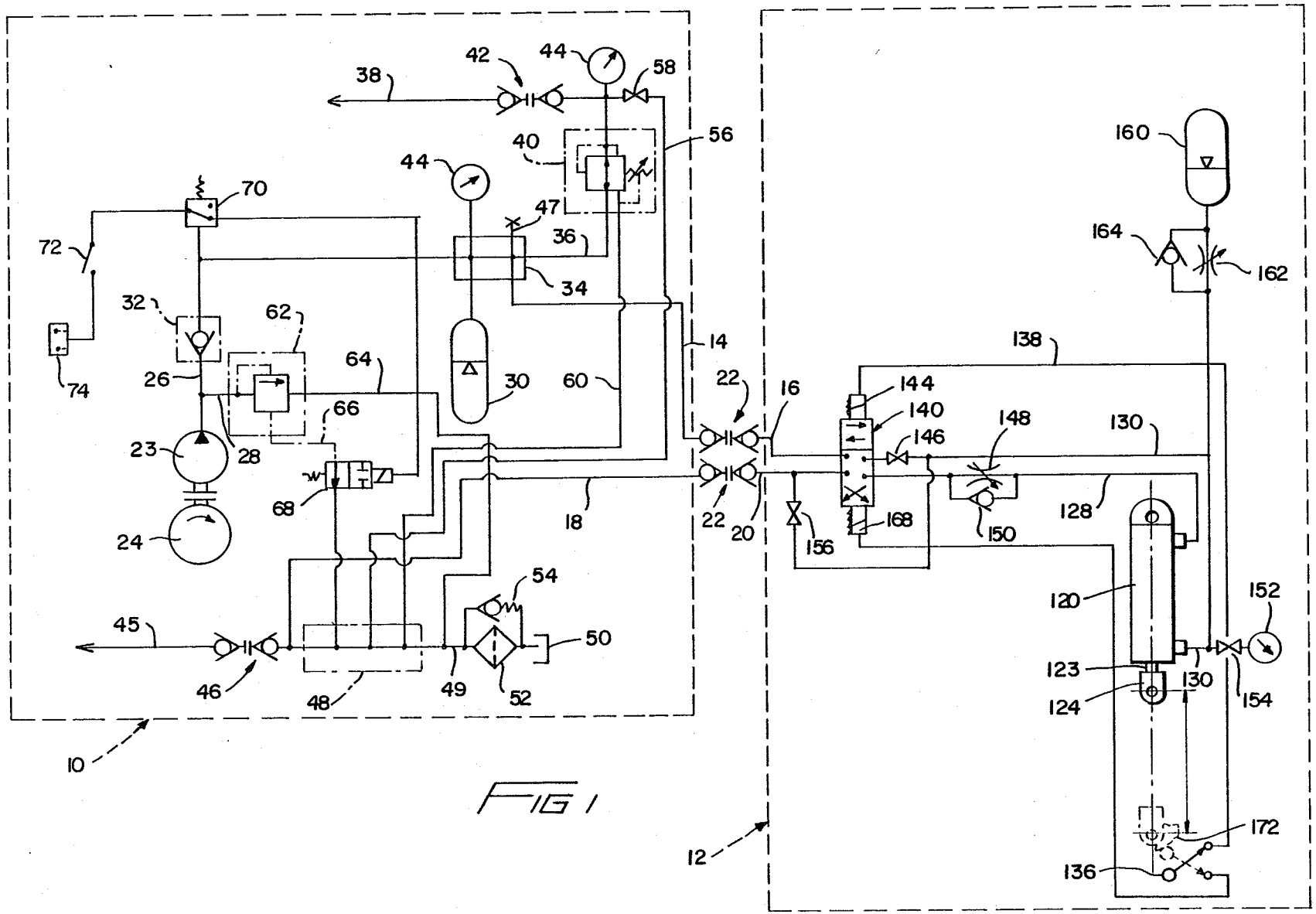
FIG. 1 is a schematic diagram of a hydraulic/electric circuit in accordance with the invention for affording recoil/counterrecoil simulation of cannon system training apparatus.

FIG. 1 illustrates an electrical/hydraulic system for imparting to a cannon system firing trainer a recoil/counterrecoil motion similar to that which would be imparted during an actual firing. As shown, the system of FIG. 1 includes a first portion 10, which comprises a source of pressurized hydraulic fluid, and a second portion 12, which comprises a recoil/counterrecoil circuit. Hydraulic fluid source 10 supplies hydraulic fluid under pressure via an outlet line 14 to a corresponding inlet supply line 16 of the recoil/counterrecoil circuit, and provides a hydraulic fluid return line 18 for a corresponding return line 20 of the recoil/counterrecoil circuit. Lines 14 and 16 and 18 and 20 may be connected by quick disconnect couplings 22. Cannon systems of the type to which the invention pertains are typically installed on a vehicle, such as a tank or a self propelled howitzer, and hydraulic fluid source 10 may comprise a conventional hydraulic power pack of the vehicle which is employed for powering other vehicle systems.

As shown in the figure, the hydraulic fluid source 10 may comprise a pump 23, such as a low volume pump, driven by a motor 24. Pump 23 may be connected to two branch lines 26 and 28. By means of line 26, the pump supplies fluid under pressure to a main accumulator 30 via a check valve 32 and a manifold 34. Outlet line 14, which supplies hydraulic fluid under pressure to the recoil/counterrecoil circuit 12, may be connected to manifold 34 as shown. Another line 36, also connected to the manifold, may supply hydraulic fluid under pressure to another outlet line 38 (which may supply secondary circuits, not shown) via a pressure reducing valve 40 and quick disconnect couplings 42. Pressure gauges 44 may be included for monitoring the pressure at the manifold and at the outlet of pressure reducing valve 40, as shown, and manifold 34 may have an unused port 47, which is blocked off.

A return line 45 from the secondary circuits supplied by line 38 may be connected via quick disconnect couplings 46 to another manifold 48, which is connected via a line 49 to a hydraulic fluid supply tank 50 through a filter 52 and a relief bypass valve 54 connected in parallel between the tank and the manifold. A line 56 having a shut off valve 58 therein may be connected between the outlet of pressure reducing valve 40 and manifold 48 to enable hydraulic fluid in the system to be drained back into tank 50. Another line 60 is connected between pressure reducing valve 40 and the manifold 48 for returning hydraulic fluid to the tank.

Branch line 28 from pump 23 may be connected through an overload relief valve 62 to a line 64 which is connected to a line 49 between manifold 48 and the parallel connected filter 52 and bypass relief valve 54. Relief valve 62 along with an electrically operated vent valve 68 controlled by a pressure responsive switch 70 serve to maintain the pressure in the system within a desired range of values, e.g., between 1700–2100 psi. Vent valve 68 is controlled by the pressure switch 70 which monitors the hydraulic fluid pressure in line 26 between check valve 32 and manifold 34. Pressure switch 70 may be connected to a voltage source (not illustrated) through an on/off switch 72 by means of an electrical receptacle 74, and arranged so that the voltage is applied to vent valve 68 when the switch is in open position (the position illustrated in the figure). Upon voltage being applied to vent valve 68, relief valve 62 is vented via line 66 so that the relief valve closes to connect line 28 to line 64 so that the pump merely returns fluid to the tank. Pressure switch 70 may be selected so that it switches to the open position (the position shown in the figure) when the pressure in the line between check valve 32 and manifold 34 rises to the maximum desired pressure in the system, e.g., 2100 psi, and remains in that position until the pressure drops below the minimum desired pressure in the system, e.g., 1700 psi. When the pressure drops below this minimum desired value, pressure switch 70 closes vent valve 68 so that no venting of relief valve 62 occurs, thereby enabling the pump to bring up the hydraulic pressure in the system back to the desired range.

As previously mentioned, the hydraulic fluid source portion 10 of FIG. 1 serves as a source of high pressure hydraulic fluid for the recoil/counterrecoil circuit 12, and should be capable of providing a high intermittent fluid flow capacity and pressure sufficient to operate the recoil/counterrecoil circuit. Any hydraulic fluid source capable of accomplishing this purpose may be employed. The hydraulic fluid source 10 illustrated schematically in FIG. 1 corresponds generally to a conventional hydraulic power pack of the type typically associated with cannon systems with which the invention may be employed, and is illustrative of a suitable power source for the recoil/counterrecoil circuit.

Prior to describing the recoil/counterrecoil circuit 12 of FIG. 1, a portion of a typical cannon system will first be described by reference to FIG. 2 in order to facilitate a better understanding of the invention.

Figure 2:
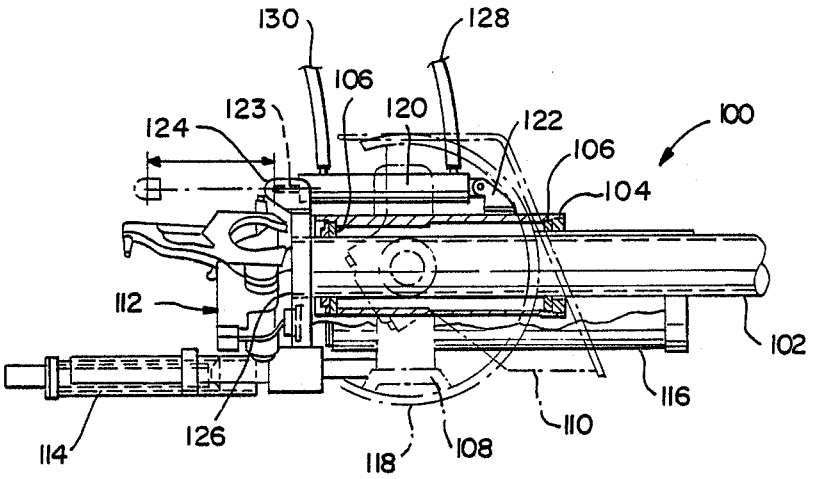
FIG. 2 illustrates a portion of cannon system firing training apparatus in accordance with the invention.

As shown in FIG. 2, a typical cannon system 100 of the type with which the invention may be employed comprises a recoiling gun tube or barrel 102. The rear or breech end of the gun tube is disposed within a gun mount cylinder 104 and is supported therein for reciprocal axial movement by bushings 106. Cylinder 104 is connected to a gun mount cradle 108, which is in turn supported by a trunnion mount 110 so that the elevation of the gun tube may be varied. The cannon system may have a screw type or sliding breech 112 and a projectile rammer 114, which in the form illustrated in the figure may comprise a hydraulically operated cylinder, for ramming projectiles into the gun tube. The cannon system may further have a conventional recoil cylinder 116 as part of the cradle. The cradle may also be fitted with a semi-circularly shaped deflector shield 118.

The elements of the cannon system described so far are all conventional. When the cannon is fired, recoil forces exerted on the gun tube cause it to move to the left in the figure so that it slides relative to the gun mount cylinder 104. The gun tube is then counterrecoiled back to the in-battery position illustrated in the figure.

In accordance with the invention, the recoil and counterrecoil movements of the gun tube may be effected without firing of the cannon system by means of a double acting hydraulic cylinder 120 attached to the conventional system. As shown in the figure, one end of the hydraulic cylinder 120 may be coupled to the gun mount cylinder 104 by a bracket 122 attached thereto, and the shaft or rod 123 of the moveable piston (not shown) of the hydraulic cylinder may be coupled to a bracket 124 connected to the breech end 126 of the gun tube. As will be described in more detail shortly, when hydraulic fluid under pressure is supplied to a first inlet line 128 at the bore side of the hydraulic cylinder, the piston of the hydraulic cylinder is forced to the left in the figure causing the piston rod and bracket 124 to move to the phantom line position illustrated. This imparts a corresponding leftward recoil movement to the gun tube causing it to slide relative to the gun mount cylinder 104 to a recoil position. Counterrecoil movement of the gun tube is then effected by supplying hydraulic fluid under pressure to the rod side of the moveable piston of the hydraulic cylinder via another inlet line 130. This causes the piston of the hydraulic cylinder and bracket 124 to move to the right in the figure and returns the gun tube to its original in-battery position shown, thus completing a recoil/counterrecoil cycle.

The use of a double acting hydraulic cylinder, as described, for simulating the recoil and counterrecoil movement of the gun tube has the advantage of enabling an actual cannon system to be easily and simply adapated for training purposes. As noted above, the gun tube is replaced with a simulated gun tube formed to enable the dummy projectile and simulated propellant charge to pass easily therethrough, or, alternatively, an actual gun tube which has exceeded its useful life may be bored out and used. Thus, when the dummy projectile and simulated propellant are rammed into the gun tube, the ramming force causes them to be expelled from the tube.

Referring to FIG. 1, hydraulic fluid to the double acting hydraulic cylinder 120 may be controlled by an electrically operated directional control valve 140. A voltage may be applied via a switch 136 and a line 138 to one solenoid 144 of the directional control valve. This operates the directional control valve to establish straight through flow paths such that inlet supply line 16 of the recoil/counterrecoil circuit is connected to inlet line 130 of hydraulic cylinder 120 (through a shut off valve 146) and such that return line 20 of the recoil/counterrecoil circuit is connected to inlet line 128 of the hydraulic cylinder through a variable flow control valve 148 and a check valve 150 connected in parallel, as shown. A pressure gauge 152 may also be connected to inlet 130 of the hydraulic cylinder via a shut off valve 154 to enable the hydraulic pressure at the inlet to be monitored. In addition, another shut off valve 156 may be employed to bypass the directional control valve to connect inlet 130 directly to return line 20 to enable the system to be drained when the shut off valve is opened. Inlet 130 of the hydraulic cylinder is also connected to a counterrecoil accumulator 160 via another variable flow control valve 162 and a check valve 164 connected in parallel, as shown.

When power is initially turned on, a voltage is applied via switch 136 to solenoid 144 of the directional control valve to establish the straight through flow paths, as previously described. Shut off valve 146, which may be manually operated, may be slowly opened to enable pressurized hydraulic fluid to be supplied from inlet supply line 16 to inlet 130 of the hydraulic cylinder and to the counterrecoil accumulator. This forces piston rod 123 of the hydraulic cylinder and bracket 124 to the solid line positions illustrated in FIGS. 1 and 2 and precharges the counterrecoil accumulator. When the counterrecoil accumulator pressure, as monitored by pressure gauge 152, reaches a desired value, e.g., 1000 psi, shut off valve 146 is closed, blocking further fluid flow from inlet line 16. Thereafter, shut off valve 146 is maintained in closed position, and the pressure in the counterrecoil accumulator insures that the cannon is held positively in the in-battery position.

When a firing signal is issued, as by actuating a firing button (not illustrated), switch 136 is moved to the phantom line position shown in FIG. 1. This causes solenoid 144 of directional control valve 140 to be deenergized, and another solenoid 168 of the directional control valve to be energized. This operates the directional control valve so that the hydraulic fluid inlet supply line 16 is connected to inlet line 128 of the hydraulic cylinder and return line 20 is connected to the closed shut off valve 146.

Under these conditions, hydraulic fluid pressurized to the operating pressure of fluid source 10, e.g., 1700–2100 psi, is supplied to inlet line 128 of the hydraulic cylinder, forcing the piston and bracket 124 connected thereto to the extended position illustrated in phantom lines in FIGS. 1 and 2 and causing the gun tube to effect a recoil motion. The main accumulator 30 of hydraulic fluid source 10 provides the intermittent high fluid flow capacity to the double acting hydraulic cylinder 120 required to effect recoil of the gun tube. During recoil, the hydraulic fluid which was stored within the double acting cylinder 120 at the rod side of the piston is displaced outwardly through inlet line 130 by movement of the piston and into the counterrecoil accumulator 160, which stores energy for counterrecoil. At the end of the recoil stroke, solenoid 168 of the directional control valve is de-energized, and solenoid 144 is re-energized, as by a cam 172 on the gun tube actuating switch 136 at the end of the recoil stroke of the gun tube. This switches the directional control valve to disconnect inlet 128 from the pressurized fluid source 10, and reconnects the inlet to return line 20. Immediately, the energy, in the form of pressurized hydraulic fluid stored in the counterrecoil accumulator 160 is imparted to the rod side of double acting hydraulic cylinder 120 through inlet line 130, forcing the piston and bracket 124 back to the solid line position illustrated in the figures and causing the cannon to counterrecoil. During counterrecoiling the hydraulic fluid volume in the bore side of the double acting hydraulic cylinder is dumped via inlet line 128 and return lines 20 and 18 to the tank 50, while the main accumulator 30 is recharged by pump 22.

The variable control valves 148 and 162 enable control of the counterrecoil and recoil speeds, respectively, by enabling control of the fluid flow rates in the lines connected to the hydraulic cylinder inlets. During recoil, check valve 150 affords free fluid flow from inlet supply line 16 to inlet 128 of the hydraulic cylinder, and variable control valve 162 controls the rate at which hydraulic fluid at the rod side of the piston of the hydraulic cylinder is expelled from inlet 130. During counterrecoil, check valve 164 affords free fluid flow to inlet 130, and variable control valve 148 controls the rate at which hydraulic fluid at the bore side of the cylinder is dumped to the return line. The variable flow control valves may be adjusted to afford desired recoil and counterrecoil speeds.

Effecting recoil and counterrecoil motions of the cannon system by employing pressurized hydraulic fluid in the manner described has a number of advantages. It affords quick action response and accurate, real-time simulation of the recoil and counterrecoil motions of the cannon system. By employing a counterrecoil accumulator to store energy produced during the recoil stroke of the recoil/counterrecoil cycle and releasing the stored energy to effect counterrecoil, high hydraulic fluid flow from the hydraulic fluid source 10 is required only during the recoil half of the cycle, and pump 23 can recharge the main accumulator 30 to the operating pressure of the system during the counterrecoil half of the cycle. Moreover, the accumulators 30 and 160 absorb the shocks produced during recoil and counterrecoil. In addition, by employing a double acting hydraulic cylinder which is positively driven in opposite directions by controlling the supply of hydraulic fluid thereto, better control over the recoil and counterrecoil motions of the cannon system is afforded, and accurate self-repositioning of the cannon to the in-battery position is assured. Finally, the invention has a simplified structure and may be readily implemented inexpensively and easily on existing cannon systems. If desired, rather than employing a double acting hydraulic cylinder for effecting the recoil and counterrecoil motions of the gun tube, the existing recoil cylinder (116 of FIG. 2) may be modified to make it a double acting hydraulic cylinder to perform the same function as that described for hydraulic cylinder 120.

While a preferred embodiment of the invention has been shown and described, it will be appreciated by those skilled in the art that changes may be made in this embodiment without departing from the principles and spirit of the invention, the scope of which is defined in the appended claims.

I claim:

1. Cannon system training apparatus for simulating movements of the cannon system which exist during firing for training operating crews without actual firing of the cannon system, comprising a gun tube supported by mounting means for reciprocal movement with respect to the mounting means between an in-battery position and a recoiled position; double acting hydraulic cylinder means connected to the gun tube and to the mounting means for moving the gun tube from the in-battery position to the recoiled position and back to the in-battery position, the hydraulic cylinder means being responsive to hydraulic fluid supplied to a first inlet thereof for moving the gun tube in a first direction to said in-battery position to simulate a counterrecoil movement and being responsive to hydraulic fluid supplied to a second inlet thereof for moving the gun tube in a second direction to the recoiled position to simulate a recoil movement; a source of pressurized hydraulic fluid; an accumulator connected to said first inlet for receiving hydraulic fluid from the hydraulic cylinder means upon said movement to the recoiled position; and hydraulic control means for connecting the source of pressurized hydraulic fluid to said second inlet of the hydraulic cylinder means so as to cause the gun tube to move from said in-battery position to said recoiled position and, upon reaching said recoiled position, for disconnecting the source from said second inlet to enable pressurized hydraulic fluid from said accumulator to enter the first inlet and return the gun tube to said in-battery position, thereby causing said gun tube to execute recoil and counterrecoil motions.

2. The apparatus of claim 1, wherein said source of pressurized hydraulic fluid has a high pressure supply line and a low pressure return line, and wherein said hydraulic control means comprises an electrically operated directional control valve for switching the second inlet between the supply line and the return line.

3. The apparatus of claim 2, wherein said directional control valve has first and second operating solenoids and has a first valve position, upon the first solenoid being energized by a voltage, at which the return line is connected to the second inlet of the hydraulic cylinder means and has a second valve position, upon the second solenoid being energized by the voltage, at which the supply line is connected to the second inlet.

4. The apparatus of claim 3 further comprising voltage switching means for maintaining the first solenoid normally energized to hold the gun tube in the in-battery position, the voltage switching means being responsive to a firing signal for de-energizing the first solenoid and for energizing the second solenoid to cause the gun tube to move to the recoiled position, and means responsive to the gun tube reaching the recoiled position for operating the voltage switching means to de-energize the second solenoid and re-energize the first solenoid to enable the gun tube to execute a counterrecoil movement and return to the in-battery position.

5. The apparatus of claim 1, further comprising first flow control means connected to the second inlet of the hydraulic cylinder means and second flow control means connected to the accumulator for controlling the flow rates of hydraulic fluid to said inlets to control the speed of movement of the gun tube in the first and second directions.

6. A system for simulating recoil and counterrecoil movements of a reciprocating gun tube of a cannon system for training operating crews without actual firing of the cannon system, comprising a double acting hydraulic cylinder connected to the gun tube, the hydraulic cylinder having first and second hydraulic fluid inlets and being arranged to move the gun tube in a first direction to an in-battery position upon hydraulic fluid being supplied to the first inlet and to move the gun tube in a second opposite direction to a recoiled position upon hydraulic fluid being supplied to the second inlet; a source of pressurized hydraulic fluid; an electrically operated control valve connected to the source of pressurized hydraulic fluid and to the second inlet, the control valve having a first position at which the source of pressurized hydraulic fluid is disconnected from the second inlet and having a second position at which the source of pressurized hydraulic fluid is connected to the second inlet; switching means for normally applying an electrical signal to the control valve to hold the control valve in the first position, the switching means being responsive to a firing signal for switching the control valve to the second position such that pressurized hydraulic fluid is applied to the second inlet to cause the gun tube to move to the recoiled position; means responsive to the gun tube moving to the recoiled position for controlling the switching means to switch the control valve back to the first position; and an accumulator connected to the first inlet of the hydraulic cylinder for storing energy in the form of pressurized hydraulic fluid discharged from the hydraulic cylinder during movement of the gun tube to the recoiled position and for releasing the stored energy to the hydraulic cylinder upon the control valve being switched back to the first position so as to move the gun tube back to the in-battery position.

7. The system of claim 6, wherein said electrically operated control valve comprises a directional control valve having first and second control solenoids for respectively disposing the control valve in said first and second positions, and said switching means comprises a switch for switching a voltage to said first and second solenoids.

8. The system of claim 7, wherein said means for controlling the switching means comprises means for actuating the switch upon the gun tube moving to the recoiled position.

9. The system of claim 6, further comprising a first variable flow control valve connected between the first inlet of the hydraulic cylinder and the accumulator and a second variable flow control valve connected between said electrically operated control valve and the second inlet of the hydraulic cylinder, the flow control valves being adjustable for varying the flow rates of hydraulic fluid to and from the hydraulic cylinder so as to control the recoil and counterrecoil speeds of the gun tube.

* * * * *